US005823650A

United States Patent [19]

Lin

[11] Patent Number: 5,823,650

[45] Date of Patent: Oct. 20, 1998

[54] DRAWER ASSEMBLY

[76] Inventor: Tsung Lung Lin, No. 146, Min Chuan Rd., Ta Hu Village, Hu Nei Hsiang, Kaohsiung Hsien, Taiwan

[21] Appl. No.: 827,469

[22] Filed: Mar. 28, 1997

[51] Int. Cl.[6] ..... A47B 88/00

[52] U.S. Cl. ..... 312/348.1; 312/348.2; 312/265.5; 411/523

[58] Field of Search ..... 312/263, 348.1, 312/348.2, 265.5; 411/174, 175, 522, 523

[56] References Cited

U.S. PATENT DOCUMENTS

| | | | |
|---|---|---|---|
| 1,352,002 | 9/1920 | Jones | 312/348.2 |
| 3,347,609 | 10/1967 | Mann | 312/263 |
| 3,403,641 | 10/1968 | Baker | 312/263 X |
| 3,729,246 | 4/1973 | Harrell et al. | 312/348.2 |
| 4,120,551 | 10/1978 | Godtschalk | 312/348.1 |
| 4,148,454 | 4/1979 | Carlson | 312/263 X |
| 4,643,610 | 2/1987 | Bien | 411/175 X |
| 4,842,351 | 6/1989 | Rock et al. | 312/263 |
| 5,337,583 | 8/1994 | Giles et al. | 411/522 X |
| 5,348,386 | 9/1994 | Grass | 312/348.2 |
| 5,494,348 | 2/1996 | Grabher | 312/348.1 |
| 5,538,339 | 7/1996 | Rock et al. | 312/348.1 |

FOREIGN PATENT DOCUMENTS

| | | | |
|---|---|---|---|
| 1278133 | 10/1961 | France | 312/265.5 |
| 2316896 | 2/1977 | France | 312/265.5 |
| 2221127 | 4/1972 | Germany | 312/265.5 |
| 2243126 | 3/1974 | Germany | 312/348.1 |
| 0054698 | 6/1943 | Netherlands | 411/522 |
| 658171 | 10/1986 | Switzerland | 312/348.1 |
| 2071995 | 9/1981 | United Kingdom | 312/348.1 |

*Primary Examiner*—Peter M. Cuomo
*Assistant Examiner*—David E. Allred
*Attorney, Agent, or Firm*—Bacon & Thomas

[57] ABSTRACT

A drawer assembly includes a bottom plate, two side plates, a front plate, and a rear plate. Hooks are provided on the bottom plate, the front plate, and the rear plate. Each side plate includes openings defined in each of a bottom member, a front side member, and a rear side member thereof. Each hook extends through an associated opening. A protrusion is formed adjacent to each opening for engagement with a hole defined in the associated hook.

4 Claims, 3 Drawing Sheets

DRAWER ASSEMBLY

BACKGROUND OF THE INVENTION

1. Field of the Invention

The present invention relates to a drawer assembly.

2. Description of the Related Art

Drawers are generally manufactured and thus take shape in the factory. Accordingly, a considerable space is required to store the drawers, yet the stacked drawers tend to mess up if inadvertently impacted. The rollers on the drawers also cause problems in the storage and transportation. Therefore, there has been a long and unfulfilled need for an improved drawer assembly which mitigates and/or obviates the above problems.

SUMMARY OF THE INVENTION

It is an object of the present invention to provide a drawer assembly which comprises a number of plates for ease of storage and transportation. The plates can be easily assembled to form a drawer when required.

A drawer assembly in accordance with the present invention comprises a bottom plate, two side plates, a front plate, and a rear plate. The bottom plate includes two lateral sides and an underside. The underside of the bottom plate includes a plurality of first hooks mounted on two sides thereof. Each first hook has a first hole defined therein.

The side plates are respectively mounted to the two lateral sides of the bottom plate. Each side plate includes a bottom member extending from a bottom thereof, a front side member extending from a first side thereof, a rear side member extending from a second side thereof, and an upper rail member. The bottom member includes a number of first openings through which the associated first hooks extend. The bottom member further includes a number of first protrusion provided on an underside thereof. Each first protrusion is adjacent to an associated first opening for engaging with the first hole of the associated first hook. The rear side member includes a plurality of second openings defined therein. The rear side member further includes a number of second protrusions provided on a side thereof. Each second protrusion is adjacent to an associated second opening. The front side member further includes a number of third protrusions provided on a side thereof. Each third protrusion is adjacent to an associated third opening.

The rear plate includes a number of second hooks on each of two sides of a face thereof which faces the rear side member. Each second hook extends through the associated second opening and has a second hole defined therein for receiving the associated second protrusion.

The front plate includes a number of third hooks on each of two sides of a face thereof which faces the front side member. Each third hook extends through the associated third opening and has a third hole defined therein for receiving the associated third protrusion.

Preferably, each of the first protrusions, the second protrusions, and the third protrusions is integral with the side plate. Alternatively, each of the first protrusions, the second protrusions, and the third protrusions is formed by piercing a fastener element through the side plate.

The front plate may include an extension extending upwardly from an edge of a lower end thereof for engagement with the underside of the bottom plate. The rear plate may include a lip formed on an upper side thereof for engagement with the rear side members.

Other objects, advantages, and novel features of the invention will become more apparent from the following detailed description when taken in conjunction with the accompanying drawings.

DESCRIPTION OF THE PREFERRED EMBODIMENT

Figure 1:
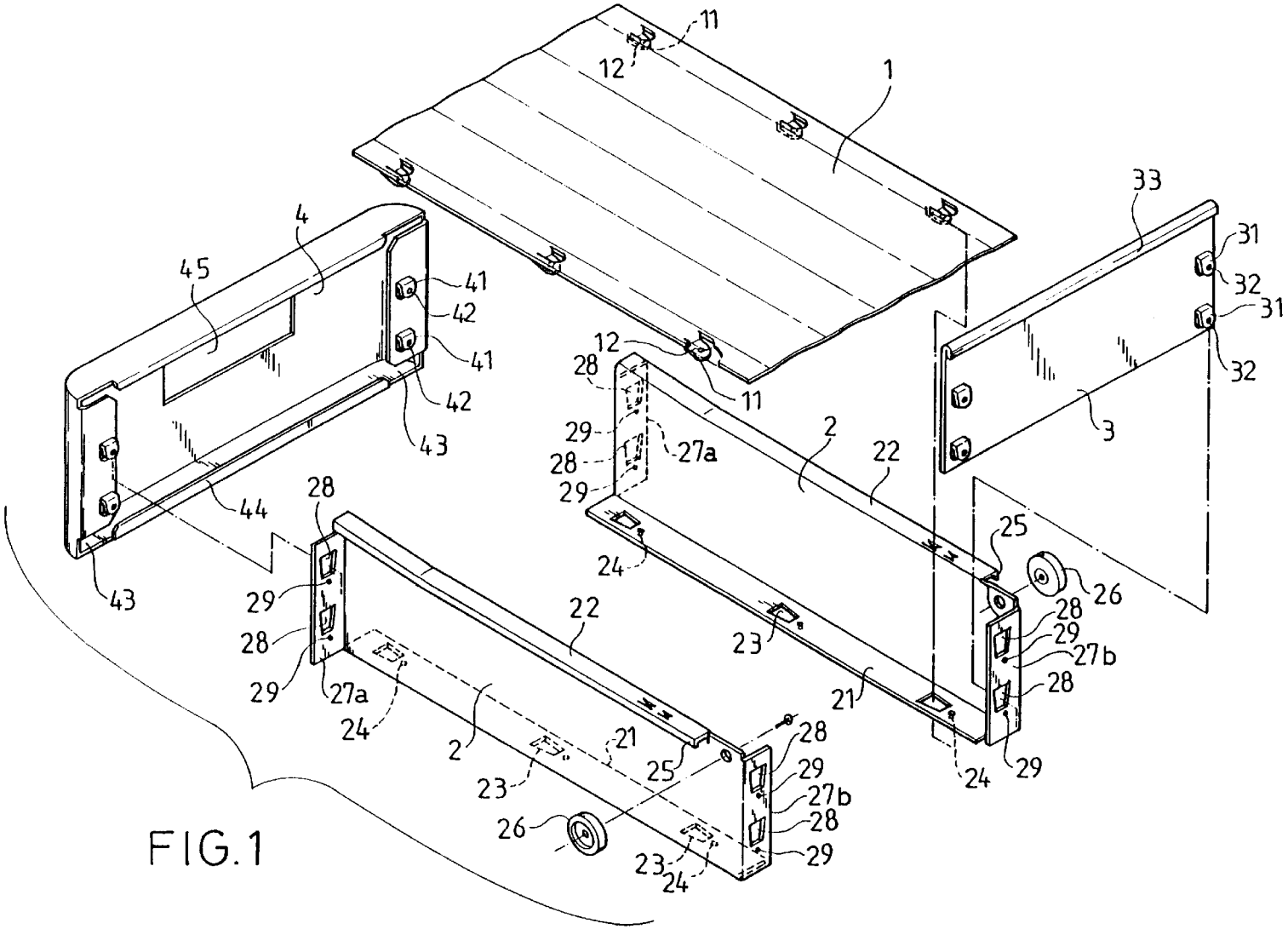
FIG. 1 is an exploded perspective view of a drawer assembly in accordance with the present invention.
Figure 2:
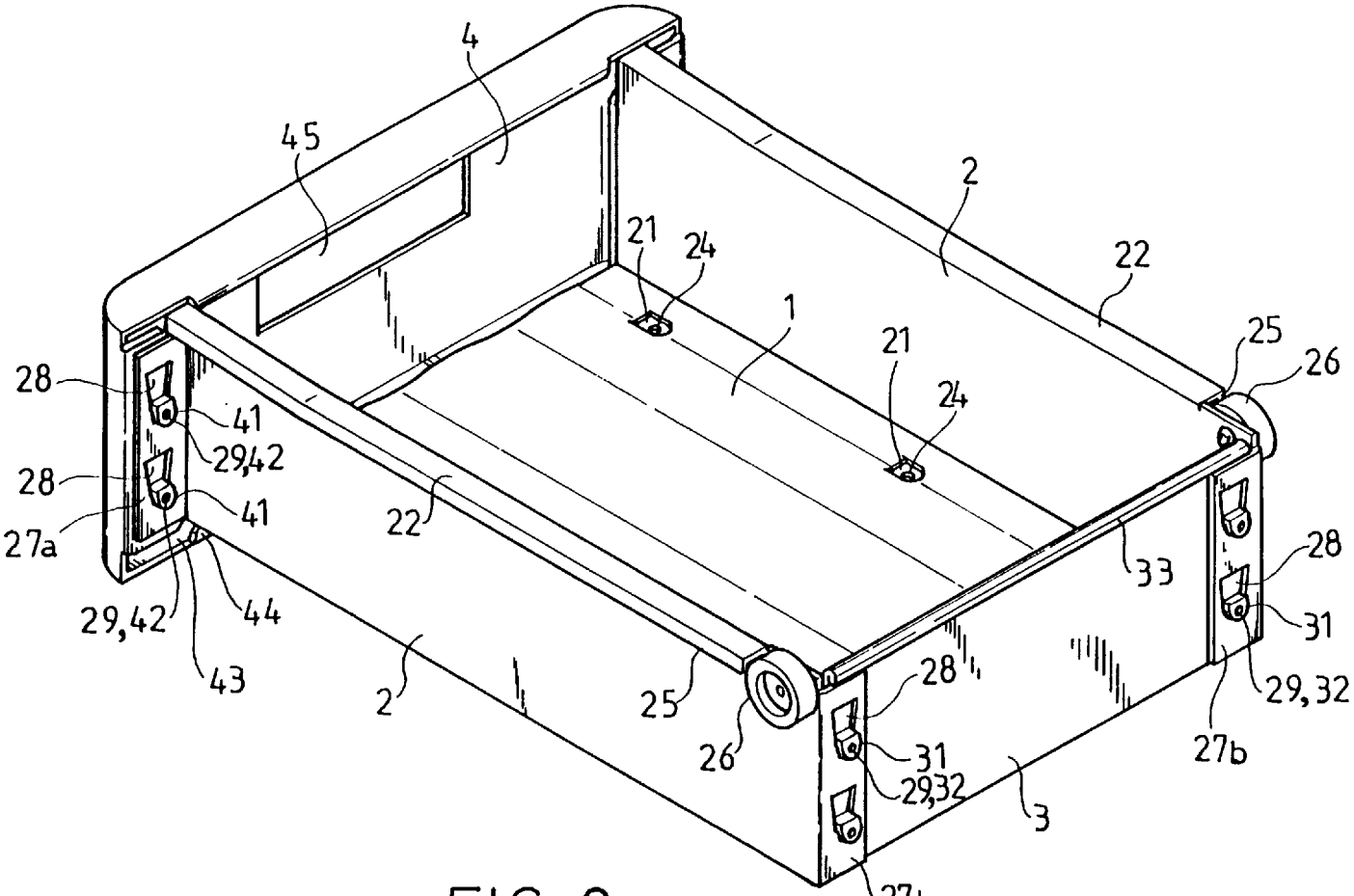
FIG. 2 is a perspective view of the drawer assembly in accordance with the present invention.

Referring to the drawings and initially to FIGS. 1 and 2, a drawer assembly in accordance with the present invention generally comprises a bottom plate 1, two side plates 2 respectively mounted to two lateral sides of the bottom plate 1, a rear plate 3, and a front plate 4. The bottom plate 1 includes a plurality of hooks 11 mounted on two sides of an underside thereof, each hook 11 having a hole 12 defined therein.

Figure 4:
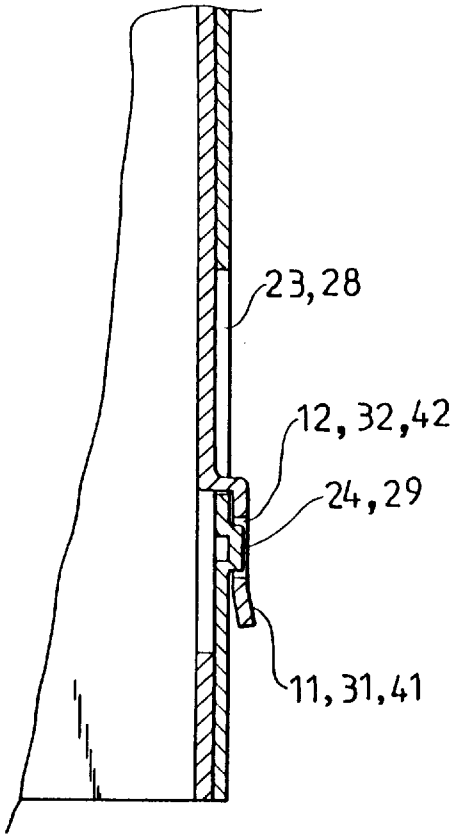
FIG. 4 is a sectional view taken along line 4—4 in FIG. 3.
Figure 3:
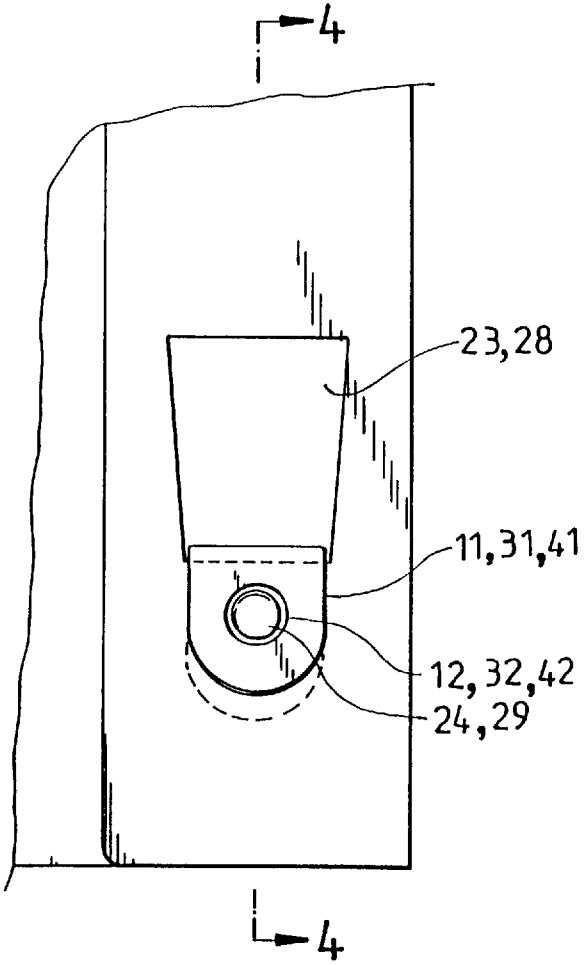
FIG. 3 is a fragmentary elevational view illustrating the hook arrangement of the drawer assembly.

Each side plate 2 includes a bottom member 21 which extends inwardly from a bottom thereof and which includes a corresponding number of openings 23 through which the associated hooks 11 extend. A protrusion 24 is provided on an underside of the bottom member 21 adjacent to each opening 23 for engaging with the hole 12 of the associated hook 11 (see FIGS. 3 and 4). Each side plate 2 further includes a front side member 27*a* and a rear side member 27*b* both of which have vertically spaced openings 28 defined therein. Again, a protrusion 29 is provided on a side of the side member 27*a*, 27*b* adjacent to each opening 28, which will be described later. As can be seen in FIG. 1, the side members 27*a* and 27*b* respectively extend from two sides of the side plate 2 and extend in opposite directions. Each side plate 2 further includes an upper rail plate 22 which extends outwardly for cooperation with a rail (not shown) mounted in a desk (not shown), which is conventional and therefore not further described. A stop 25 is formed on the rail plate 22 to limit sliding movements of the drawer, and a roller 26 is rotatably mounted to the side plate 2, which is also conventional and therefore not further described.

The rear plate 3 includes a number of vertically spaced hooks 31 on each of two sides of a face thereof which faces the rear side member 27*b*, each hook 31 having a hole 32 defined therein. Each hook 31 extends through the associated opening 28 of the rear side member 27*b* with the protrusion 29 received in the associated hole 32, thereby providing a secure engagement. In addition, the rear plate 3 includes a lip 33 formed on an upper side thereof for engagement with upper edges of the rear side member 27*b*. A length of the rear plate 3 may be greater than a distance between the rear side members 27*b* of the two side plates 2. The rear plate 3 may rest on the bottom plate 1 or extend beyond the bottom plate 1.

The front plate 4 includes a number of vertically spaced hooks 41 on each of two sides of a face thereof which faces the front side member 27*a*, each hook 41 having a hole 42 defined therein. Each hook 41 extends through the associated opening 28 of the front side member 27*a* with the protrusion 29 received in the associated hole 42, thereby providing a secure engagement. In addition, a larger opening

45 is defined in the front plate 4 for assembly of a handle (not shown). Furthermore, an extension 44 extends upwardly from an edge of a lower end of the front plate 4 for engagement with the underside of the bottom plate 1. In assembly, the bottom plate 1 extends into a recess 43 defined in the front plate 4.

According to the above description, it is appreciated that the bottom plate 1, the side plates 2, the rear plate 3, and the front plate 4 can be easily assembled by means of extending the hooks 11, 31, 41 through the associated openings 23, 28 with the protrusions 24, 29 received in the associated holes 12, 32, 42. The plates 1 to 4, when not assembled, are convenient to storage and transportation as they occupy a relatively small space.

It is appreciated that the drawer can be made of metal, plastics, or wood, or a combination thereof. The protrusions 24, 29 can be integrally formed by punching. Alternatively, the protrusions may be formed by piercing fastener elements (e.g., nails) through the respective member.

Although the invention has been explained in relation to its preferred embodiment, it is to be understood that many other possible modifications and variations can be made without departing from the spirit and scope of the invention as hereinafter claimed.

What is claimed is:

1. A drawer assembly, comprising:

a bottom plate having two opposite lateral sides, an underside, and a plurality of first hooks located adjacent to the two opposite lateral sides and displaced from the underside of the bottom plate, each of said first hooks having a first thickness and a first hole extending through the first thickness a side plate respectively mounted to each of the two opposite lateral sides of the bottom plate, each of said side plates including a bottom flange member extending from a bottom thereof, a front side flange member extending from a first side thereof, a rear side flange member extending from a second side thereof, and an upper rail member extending along an upper edge, the bottom flange member including a plurality of first openings through which associated said first hooks extend, the bottom flange member further including a plurality of first protrusions provided on an underside thereof, each of said first protrusions being adjacent to one of said first openings and engaging the first hole of the associated first hook, said rear side flange member including a plurality of second openings, said rear side flange member further including a plurality of second protrusions, each of said second protrusions being adjacent to one of said second openings, said front side flange member including a plurality of third openings, said front side flange member further including a plurality of third protrusions, each of said third protrusions being adjacent to one of said third openings;

a rear plate including a first face facing the rear side flange members and a plurality of second hooks on said first face, each of said second hooks being displaced from said first face and extending through one of said plurality of second openings, each of said second hooks having a second thickness and a second hole extending through the second thickness, each second hole engaging one of said plurality of second protrusions; and, a front plate including a second face facing the front side flange member and a plurality of third hooks on said second face, each of said third hooks being displaced from said second face and extending through one of said plurality of third openings, each of said third hooks having a third thickness and a third hole extending through the third thickness, each third hole engaging one of said plurality of third protrusions.

2. The drawer assembly according to claim 1, wherein each of said first protrusions, said second protrusions, and said third protrusions is integral with the associated side plate.

3. The drawer assembly according to claim 1, wherein the front plate further comprises an extension extending upwardly from a lower edge thereof and engaging the underside of the bottom plate.

4. The drawer assembly according to claim 1, wherein the rear plate further comprises a lip formed on an upper side thereof engaging said rear side flange members.

* * * * *